US005136210A

United States Patent [19]

Kling

[11] Patent Number: 5,136,210

[45] Date of Patent: Aug. 4, 1992

[54] GLOW DISCHARGE LAMP

[75] Inventor: Michael R. Kling, Stratham, N.H.

[73] Assignee: GTE Products Corporation, Danvers, Mass.

[21] Appl. No.: 753,259

[22] Filed: Aug. 30, 1991

[51] Int. Cl.[5] ..... H05B 39/04; H05B 41/36

[52] U.S. Cl. ..... 315/107; 315/106; 315/362; 315/291; 315/307; H05B/39/04; H05B/41/36

[58] Field of Search ..... 315/107, 106, 205, 291, 315/307, 171, 311, 352, 105

[56] References Cited

U.S. PATENT DOCUMENTS

| | | | |
|---|---|---|---|
| 2,356,379 | 8/1944 | Abernathy | 315/227 |
| 3,567,995 | 3/1971 | Lauritzen | 315/106 X |
| 3,787,751 | 1/1974 | Farrow | 315/137 |
| 4,172,981 | 10/1979 | Smith | 307/66 |
| 4,177,406 | 12/1979 | Hermeyer et al. | 315/307 |
| 4,288,725 | 9/1981 | Morton | 315/245 |
| 4,296,356 | 10/1981 | Beinitz et al. | 315/107 X |
| 4,450,385 | 5/1984 | Buhrer | 315/205 |
| 4,500,812 | 2/1985 | Roche | 315/171 |
| 4,742,276 | 5/1988 | Ku | 315/106 |
| 4,792,727 | 12/1988 | Godyak | 315/105 X |
| 4,945,291 | 7/1990 | Masaki | 315/307 |
| 4,952,844 | 8/1990 | Godyak | 315/205 |
| 5,028,844 | 7/1991 | Sakaguchi et al. | 315/307 |
| 5,068,577 | 11/1991 | Brown | 315/307 |

FOREIGN PATENT DOCUMENTS

| | | | |
|---|---|---|---|
| 1144508 | 2/1963 | Fed. Rep. of Germany | 315/107 |

*Primary Examiner*—Eugene R. Laroche
*Assistant Examiner*—Son Dinh
*Attorney, Agent, or Firm*—Robert E. Walter

[57] ABSTRACT

An electric circuit for glow discharge lamp includes a sensing and control circuit which senses the minimum of the lamp voltage wave form and adjust the filament voltage in accordance with sensed wave form and changing environmental conditions for maintaining lamp voltage at a predetermined constant value.

9 Claims, 1 Drawing Sheet

GLOW DISCHARGE LAMP

CROSS-REFERENCE TO RELATED APPLICATIONS

This application discloses features which relate to the subject matter of pending application U.S. Ser. No. 07/753,246 of kling et.al. filed Aug. 8, 1991 and entitled "Glow Discharge Lamp", and assigned to assignee of the present application.

FIELD OF THE INVENTION

The present invention relates to negative glow discharge lamps and electronic ballast circuits for use with such lamps.

BACKGROUND OF THE INVENTION

A negative glow discharge lamp typically comprises a light-transmitting envelope containing a noble gas and mercury with a phosphor coating on an inner surface of the envelope which is adapted to emit visible light upon absorption of ultraviolet radiation that occurs when the lamp is excited. The lamp is excited by means of the application of a voltage between the lamp electrodes. Current flows between the electrodes after a certain potential is applied to the electrodes, commonly referred to as the breakdown voltage. An elementary explanation of the phenomenon is that the gas between the electrodes becomes ionized at a certain voltage, conducts current, and emits ultraviolet radiation. The phosphor coating on the inner surface of the lamp envelope is caused to fluoresce and re-emit a substantial portion of the ultraviolet radiation as visible light. The spectral characteristics of the visible light is determined principally by the composition of the fluorescent powders used for the phosphor coating. During operation, negative glow discharge lamps generally require a series-connected current-limiting device. Without the current being limited, the discharge potential drops and the current increases until the lamp fails due to current overload.

Prior U.S. patents describe the use various of ballast circuits to control the current. The use of capacitive ballasts with or without rectifier circuits are described in U.S. Pat. No. 2,356,369 to Abernathy; U.S. Pat. No. 4,288,725 to Morton, U.S. Pat. No. 4,172,981 to Smith, U.S. Pat. No. 4,500,812 to Roche, and U.S. Pat. No. 3,787,751 to Farrow. U.S. Pat. No. 4,952,844 to Godyak et.al. describes a ballast using a rectifier bridge intercoupling a capacitor and the electrodes of the lamp.

One major problem common to negative glow lamps is their sensitivity to operating conditions. The lamp voltage is determined primarily by cathode fall which is in turn dependent on mercury vapor pressure, cathode condition, and amount of external cathode heat provided. When mercury vapor pressure is low, as in the case during lamp warm-up, under dimming, and with low ambient temperature, cathode fall increases so that severe sputtering damage and lowered efficacy due to buffer gas excitation may result. When mercury vapor pressure is high due to high ambient temperature or before stabilization, cathode fall and lamp voltage are low reducing lamp wattage and efficacy. The negative glow lamp is also very sensitive to changes in cathode quality which increase or decrease emissivity resulting in the same problems.

Because of the high discharge current and low voltage attendant with a negative glow discharge lamp, the most practical ballast for the lamp is electronic. Under normal operating conditions, the direct current negative glow lamp requires circulatory current to achieve adequate cathode temperature. In the direct current lamp, the cathode receives its power from a combination of ion bombardment, $I^2R$ heating from the discharge current, and from the externally supplied circulatory current. These requirements change when the lamp is dimmed or operated in hot or cold environments. Thus, optimization of the ballast circuit to take into account these variables is difficult.

When overheated, the thermionic emission increases and the cathode fall drops below optimum reducing lamp power and efficacy. At some point the discharge becomes unstable and flicker is objectionable. When underheated, the cathode fall increases causing rapidly increasing sputtering damage and shortened life. Therefore, the negative glow lamp is extremely sensitive to operating conditions which shift the lamp voltage away from the optimum range with resulting short life or poor efficacy.

SUMMARY OF THE INVENTION

Because of the high discharge current and low voltage of negative glow lamps as well as other considerations, the most practical ballast is electronic. The negative glow lamp is extremely sensitive to operating conditions which shift the lamp voltage away from the optimum range with resulting short life or poor efficacy.

In copending application U.S. Ser. No. 07/753,246 previously referred to, a method of improving lamp performance over a wide range of conditions by controlling lamp voltage is described. This is accomplished by varying cathode heating power based on lamp voltage. When lamp voltage increases due to low mercury vapor pressure, changing discharge current, or cathode aging, the circulatory power is increased thereby heating the cathode and reducing the cathode fall and lamp voltage.

The above ballasts work well at providing dimming, starting performance, and compensation for changes in ambient temperature. However, under some conditions, such as starting in dimmed mode and rapid dimming, the ballast may lock into an unstable mode characterized by high RMS lamp voltage and overheated cathode.

Accordingly, it is an object of the present invention to provide an improved electronic ballast circuit which obviates one or more disadvantages of the above described ballast. According to the present invention, negative glow lamp stability when operated at constant voltage with a variable cathode heating ballast can be improved by controlling the circulatory filament voltage based on minimum lamp voltage of any oscillations rather than average or peak voltage.

Thus, there is provided improvement in a glow discharge lamp of the type having an electronic circuit for regulating lamp output according to changing environmental conditions where the lamp comprises a light transmitting envelope having a phosphor coating and containing mercury and a noble gas fill; an anode disposed in said envelope having a single lead-in wire; a cathode lamp filament located within said envelope having a pair of lead-in wires; a power lamp circuit electrically connected to between said anode lead-in wire and said cathode for creating a lamp voltage; a filament power circuit electrically connected to said pair of cathode lamp filament lead-in wires for creating a filament voltage whereby said lamp voltage decreases with an increasing filament voltage; a sensing and control circuit for adjusting the filament voltage in accordance with changing environmental conditions for maintaining lamp voltage at a predetermined constant value; wherein the improvement comprises said sensing and control circuit including means for periodicity detecting the minimum of the lamp voltage wave form and altering said filament voltage for maintaining said lamp voltage at said predetermined value.

BRIEF DESCRIPTION OF THE DRAWINGS

The invention will become more readily apparent from the following exemplary description in connection with the accompanying drawings, wherein.

BEST MODE FOR CARRYING OUT THE INVENTION

For a better understanding of the present invention, together with other and further objects, advantages and capabilities thereof, reference is made to the following disclosure and appended claims in connection with the above-described drawings.

Figure 1:
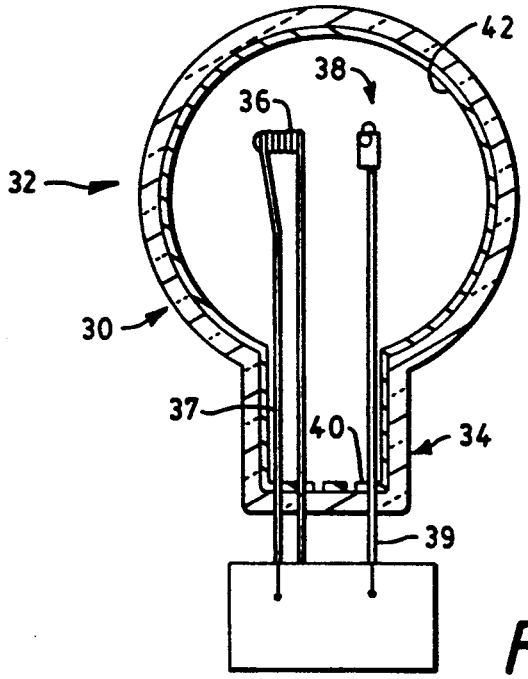
FIG. 1 represents an cross-sectional view of a direct current negative glow discharge lamp.

Reference is made to FIG. 1 where a lamp envelope 30 has a bulbous region 32 and a neck region 34. Within the envelope 30 there is disposed a cathode electrode 36 and an anode electrode 38. The envelope contains a fill material that emits ultraviolet radiation upon excitation. The fill material contains mercury and a noble gas or mixture of noble gases. In one embodiment the lamp may be filled with a noble gas mixture at 3 torr. This mixture may be 99.5% neon and 0.5% argon with approximately 30 mg in weight of mercury. The inner surface of the envelope 30 is coated with phosphor coating 42 having spectral characteristics of the visible light determined by the composition of the fluorescent powders used for the phosphor coating.

The cathode electrode 36 may be a standard tungsten exciter coil. Lead-in wires 37 support the cathode electrode 36 and provide current to heat the cathode 36. The cathode electrode 36 is coated with an emissive material such as a barium containing material. A single lead-in wire 39 supports the anode electrode 38. The rod like lead-in wires 37 and 39 are hermetically sealed such as by a wafer stem assembly 40 such as known in the art.

In the glow discharge lamp, lead-in wire 39 is connected to the positive terminal of a d.c. power supply. Lead-in wires 37 are connected to the negative terminals of the power supply. Lamp voltage is measured between the circuit ground and the anode electrode 38. Upon ignition, a glow discharge is produced between anode 38 and cathode 36. Various techniques may be utilized to start the lamp. In a preheat start, the cathode is heated with a specified preheat current for about one second before application of lamp power. In a rapid start where a glow to arc transition occurs, circulatory current and lamp power are applied simultaneously. In an instant start, a high open circuit voltage starts the lamp without preheat.

After start-up and during lamp operation, the cathode current is adjusted to maintain a preferred predetermined lamp voltage and varies in accordance with environmental conditions. Due to the glow lamp operating characteristics, lamp voltage decreases with an increasing filament voltage due to increased thermionic emission. If the temperature of the lamp environment decreases, the lamp voltage may undesirably increase so that an appropriate increase in the filament voltage is desirable to increase the filament current and increase the emissivity of the electrode so as to reduce the lamp voltage. On the other hand, if the operating temperature of the lamp increases, the lamp voltage may decrease below the desired predetermined value. In this case, the lamp voltage may be desirably increased to the appropriate value by decreasing filament voltage which decreases the filament current and the thermionic emission of the cathode. The decreased thermionic emission from the cathode increases the lamp voltage. Preferably, the lamp voltage is maintained from about 12 to about 16 volts, more preferably about 14 to 16 volts.

If the wave form of the lamp voltage is shown in graphical form with the voltage along the x-axis and time along the y-axis, the wave form exhibits certain discernable features. The peak voltage of the wave form is represented by the tops or the peaks of the wave form while the bottoms of the valleys or troughs represent the minimum voltage of the wave form. In the present invention, the circulatory voltage is controlled based on the minimum lamp voltage of the wave form.

Figure 2:
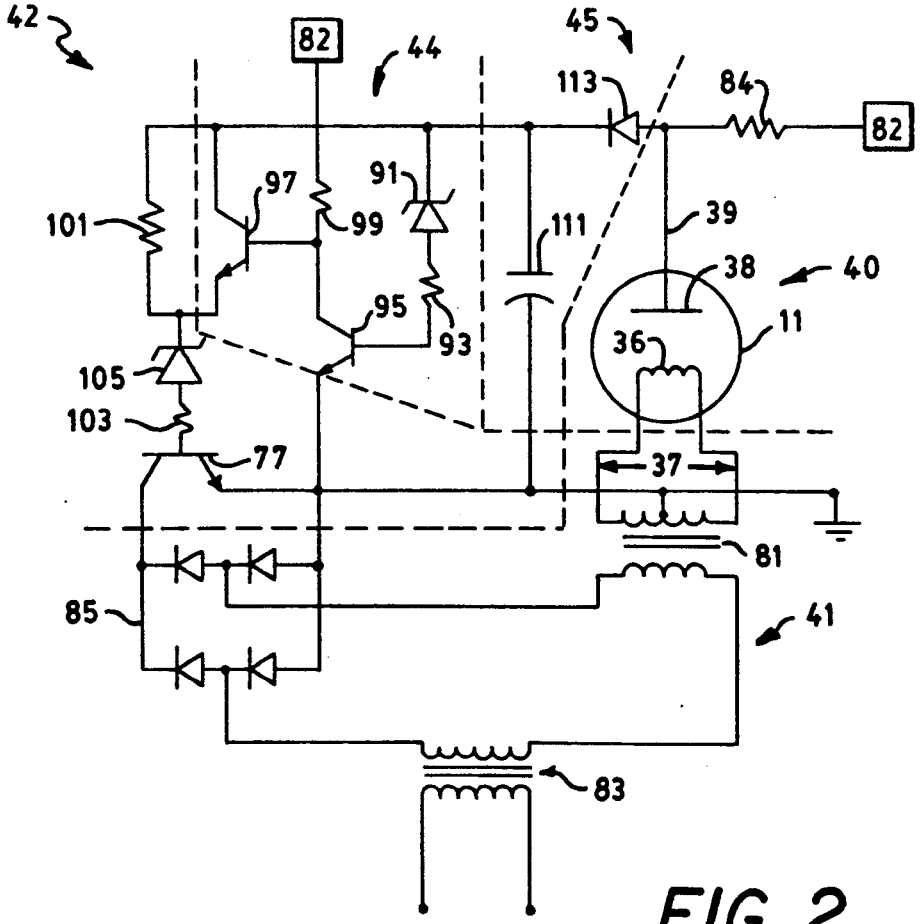
FIG. 2 is a schematic diagram of a circuit for starting and operating a negative glow discharge lamp according to the present invention.

FIG. 2 illustrates a circuit where minimum lamp voltage is utilized. The circulatory current is regulated based on the voltage across capacitor 111. Capacitor 111 charges through resistor 115 and is supplied from the power source 82. Resistor 115 must be less than the impedance of the sensing and control circuit 42 to enable capacitor 111 to charge. Capacitor 119 is optional. When the circuit is functioning normally with a stable discharge, there is very little ripple in the lamp voltage and capacitor 111 voltage equals capacitor 119 voltage. If the system is perturbed into an unstable mode, the time constant of resistor 115 times capacitor 111 is such that capacitor 111 can not track the voltage oscillations and remains near the minimum lamp voltage. Typically, the minimum voltage is below 15 volts up to a fairly high level of circulatory power so circulatory power is controlled at a reasonable level and the cathode rapidly cools until the normal cathode sheath forms and stable operation resumes.

In the following detailed example, the circuit as set forth in FIG. 2 was tested. The circuit components are as follows. The lamp 11 is a low voltage, high current negative glow discharge lamp having a anode 38 and circuit ground. The lamp voltage is measured across the anode 38 and cathode 36. In accordance with the principles of the present invention, it is desirable to maintain the lamp voltage during operation of the lamp at a relatively constant voltage, preferably from about 13 to about 15 volts.

The circuits utilized control the filament voltage or the voltage across the cathode 36 in a precise manner. A power lamp circuit 40 is utilized to supply electrical current across the anode and cathode according to the lamp voltage. A filament power circuit 41 for supplies electrical current across the filament in accordance with a filament voltage, and a sensing and control circuit 42 senses changes in the lamp voltage and adjusts the filament voltage to maintain the the lamp voltage at a relative constant voltage.

The power lamp circuit 40 includes a 35 volt D.C. power supply 82, a resistor 84, and capacitor 119. The capacitor 119 is in parallel with the lamp. The filament power circuit 41 includes a transformer 83 which reduces the A.C. 120 volt power supply to 12.6 volt A.C.. A rectifier bridge 85 converts the A.C. to full wave rectified D.C. The cathode 36 is connected to the center tap transformer 81 as hereinbefore described. The center-tapped coil of the transformer 81 associated with the power lamp circuit 40 is connected to ground and to one terminal of the the rectifier bridge 85. The coil of the transformer 81 associated with the filament circuit 41 is connected to one side of the 12.6 volt transformer winding and another terminal of the rectifier bridge 85 so as to provide a source of AC power to the bridge rectifier.

The start-up circuit 44 includes a zener diode 91 which permits current to flow when a predetermined voltage such as 18 volts is exceeded. The resistor 93 is connected in series with the base of transistor 95 which together with transistor 97 and resistor 99 controls the current flow through zener diode 105 at the higher voltage levels associated with lamp start-up. During start up switching transistor 97 diverts current through resistor 101 which provides a high resistance path. After an initial lamp start up, when the lamp voltage reduces to less than the predetermined value, transistor 95 cuts off and transistor 97 turns on shunting resistor 101 and providing a low resistance circuit to operate transistor 77 for maximum dynamic gain as shown by Eq. 1.

After start up, the function of the filament power circuit 41 is to control the filament voltage and hence the lamp voltage in accordance with changing conditions during operation so that the lamp voltage remains relatively constant. This is performed by the resistors 101, 103 and zener diode 105.

The sensing and control circuit 42 includes a pair of resistors 101 and 103 connected in series to limit the base current to the control transistor 97 and zener diode 105. The zener diode 105 only permits the flow of current provided the voltage exceeds a predetermined value, i.e. 11.4 volts for the device shown in the drawing. Hence, for voltage levels under a predetermined value, the sensing and control circuit 42 is inoperative.

Once the voltage as determined by the zener diode 105 is exceeded, current flows in the sensing and control circuit 43 causing the transistor 103 to establish the current flow in the filament power circuit 41 and hence maintain a constant lamp voltage. The transistor 103 acts as a voltage sensitive switch. Current regulation in the filament power circuit 41 is in accordance with the formula $$dI_c/dV_1]_{V_Z=11.4v}=\beta/R_3+R_4$$

where $\beta$ is the transistor amplification factor.

Accordingly, the circuit was operated with the following settings: filament power voltage 61 at 15 volts, lamp power voltage at 35 volts, resistor 54 at 5 ohms, resistor 53 at 50 ohms, resistor 71 at 50 ohms, and resistor 73 at 27 ohms. The zener diode 75 and transistor 77 values are as previously set forth. The nominal lamp values were $V_1=14$ volts, $I_1=2$ amps, $V_c=3$ volts, $I_c=1.3$ amps. Note that $dI_c/dV_1$ can be increased by selecting a value for $V_z$ closer to $V_1$ and adjusting $R_3$ accordingly.

The diode 113 and the resistor 115 are connected in parallel between the capacitor 111 and the anode 38. The diode 113 and capacitor 111 arrangement result in a leveling out of the wave form and filtering out the ripple in the lamp A.C. voltage so that minimum voltage in the wave form is sensed. Removing resistor 115 and diode 113 provides for instantaneous sensing. Peak sensing is obtained by reversing the diode orientation and removing resistor 115 as is disclosed in copending application U.S. Ser. No. 07/753,246 previously discussed.

A quantitative test was performed utilizing the three above described sensing methods (minimum, peak, and instantaneous lamp voltage) and the results are reported in Table 1. 119 is 50uF, 115 is 10 ohms, and the impedance of the sensing circuit was estimated at less than 100 ohms. Peak sensing utilized filtered DC for discharge current and 60 Hz, center tapped AC for circulatory power. The maximum available circulatory voltage is about 8 volts RMS and the feedback gain in the control circuit is about 4.3. The feedback profile is approximately linear.

System stability was judged by switching from 2.0 amps discharge current to a dimmed level and observing any oscillations or flicker. This test was repeated with sequentially lower currents until a minimum stable dimming level was established. With instant dimming to currents below this level the system either hung-up in a flicker mode or flickered for less than 2 seconds before damping. Lower minimum currents indicated improved stability.

| CATHODE | ANODE | CIR. WATTS | MINIMUM | INSTANTANEOUS | PEAK |
|---|---|---|---|---|---|
| Triple | Std. | 3.0 | 0.090 | 0.168 | 0.160 |
| Triple | Std. | 6.0 | 0.100 | 0.149 | 0.228 |
| Stick | Std. | 6.0 | 0.040 | 0.097 | 0.122 |
| Stick | Small | 6.0 | 0.236 | 0.126 | 0.324 |
| Stick | Small | 8.0 | 0.182 | 0.208 | 0.230 |

In every case tested, the minimum voltage sense circuit configuration could be dimmed to a lower current than the peak sensing configuration. Minimum voltage sense also proved better than sensing instantaneous lamp voltage in most cases. The improvements in dimming stability would imply greater latitude in preheat power also. By optimizing the values of resistor 115, impedance of the sensing circuit, capacitor 119, and capacitor 111, dimming with constant voltage ballasts could be further improved.

When filtered DC discharge voltage is used, all three sensing methods should give equal voltage control under normal stabilized operation. The differences become apparent when lamp voltage oscillations occur such as with rapid dimming and preheat starting in a dimmed mode.

The minimum currents reported above do not fully describe the performance differences between the sense methods. With instant dimming to lower currents, the peak sensing circuit tended to hang-up and destroy the cathode. With minimum voltage sense, the oscillations simply required longer than 2 seconds to damp out with no sign of cathode damage.

In the present invention, the sensing of minimum lamp voltage provides greater flexibility in ballast design and more stable operation of the lamp/ballast system than could be achieved by tracking actual lamp voltage or peak lamp voltage.

While there have been shown and described what are at present considered to be the preferred embodiments of the invention, it will be apparent to those skilled in the art that various changes and modifications can be made herein without departing from the scope of the invention. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. An improvement to a glow discharge lamp of the type having an electronic circuit for regulating lamp output according to changing environmental conditions where the lamp comprises a light transmitting envelope having a phosphor coating and containing mercury and a noble gas fill; an anode disposed in said envelope having a single lead-in wire; a cathode lamp filament located within said envelope having a pair of lead-in wires; a power lamp circuit electrically connected to between said anode lead-in wire and said cathode for creating a lamp voltage; a filament power circuit electrically connected to said pair of cathode lamp filament lead-in wires for creating a filament voltage whereby said lamp voltage decreases with an increasing filament voltage; a sensing and control circuit for adjusting the filament voltage in accordance with changing environmental conditions for maintaining lamp voltage at a predetermined constant value; wherein the improvement comprises said sensing and control circuit including means for detecting the periodic minimum of the lamp voltage wave form and altering said filament voltage for maintaining said lamp voltage at said predetermined value.

2. A glow discharge lamp having an electronic circuit for regulating lamp output according to changing environmental conditions according to claim 1 wherein said predetermined voltage is from about 12 to about 16 volts.

3. A glow discharge lamp having an electronic circuit for regulating lamp output according to changing environmental conditions according to claim 2 wherein said sensing and control circuit include a zener diode for sensing when said voltage exceeds a desired predetermined value.

4. A glow discharge lamp having an electronic circuit for regulating lamp output according to changing environmental conditions according to claim 3 wherein said sensing and control circuit include a switching transistor for sensing when said voltage exceeds a desired predetermined value and adjusting filament voltage.

5. A glow discharge lamp having an electronic circuit for regulating lamp output according to changing environmental conditions according to claim 2 wherein said sensing and control circuit include a lamp start-up circuit for limiting control current and voltage during start-up.

6. A glow discharge lamp having an electronic circuit for regulating lamp output according to changing environmental conditions according to claim 2 wherein said power lamp circuit is a source of direct current.

7. A glow discharge lamp having an electronic circuit for regulating lamp output according to changing environmental conditions according to claim 6 wherein said filament power circuit is a source of alternating current.

8. A glow discharge lamp having an electronic circuit for regulating lamp output according to changing environmental conditions according to claim 6 wherein said filament power circuit is a source of direct current.

9. A glow discharge lamp having an electronic circuit for regulating lamp output according to changing environmental conditions according to claim 7 wherein said filament power circuit is a source of direct current rectified from alternating current.

* * * * *